US009865230B2

(12) United States Patent
Marison et al.

(10) Patent No.: US 9,865,230 B2
(45) Date of Patent: Jan. 9, 2018

(54) ANIMATED VISUALIZATION OF ALPHA CHANNEL TRANSPARENCY

(75) Inventors: Scott Robert Marison, Honolulu, HI (US); Jean-Pierre Joseph Duplessis, Kirkland, WA (US); Justin Toshiyuki Goshi, Honolulu, HI (US); Emmanuel John Athans, Seattle, WA (US)

(73) Assignee: Microsoft Technology Licensing, LLC, Redmond, WA (US)

( * ) Notice: Subject to any disclaimer, the term of this patent is extended or adjusted under 35 U.S.C. 154(b) by 549 days.

(21) Appl. No.: 13/539,877

(22) Filed: Jul. 2, 2012

(65) Prior Publication Data

US 2014/0002487 A1 Jan. 2, 2014

(51) Int. Cl.

| | |
|---|---|
| ***G09G 5/00*** | (2006.01) |
| ***G09G 5/14*** | (2006.01) |
| ***G09G 5/02*** | (2006.01) |

(52) U.S. Cl.

CPC ..... *G09G 5/14* (2013.01); *G09G 5/026* (2013.01)

(58) Field of Classification Search

CPC .... G01J 3/462; G01J 3/465; G01J 3/50; G01J 3/524; G09G 5/00; G06T 3/4038; G06T 15/503; G06T 15/506; G06T 1/20; H04N 19/0003; H04N 19/0026; H04N 19/00412; G11B 27/005; G11B 27/034; G09B 21/009; H04R 25/505; G10L 15/08; G10L 2021/0575; G10L 2021/065;

(Continued)

(56) References Cited

U.S. PATENT DOCUMENTS

| | | | |
|---|---|---|---|
| 6,211,881 | B1 | 4/2001 | Gabler et al. |
| 6,400,832 | B1 | 6/2002 | Sevigny |

(Continued)

OTHER PUBLICATIONS

"Using Video and Graphics Clips with Alpha Channels", Retrieved at <<http://documentation.apple.com/en/finalcutpro/usermanual/index.html#chapter=71%26section=6%26tasks=true>>, Jan. 16, 2010, pp. 7.

(Continued)

*Primary Examiner* — Gregory J Tryder
*Assistant Examiner* — Kwang Lee
(74) *Attorney, Agent, or Firm* — Ogilvie Law Firm

(57) ABSTRACT

Visual inspection of alpha channel values is aided by displaying a partially transparent image rendered over an animated background pattern. The background pattern is user-specified or chosen automatically. The background pattern has colors, shapes, position, orientation, magnification, and distortion. The visual appearance of the background pattern is automatically altered, and the partially transparent image is redisplayed, this time rendered over the altered background pattern. The background pattern may scroll, rotate, change shape, pulse, morph shape, and/or change colors during animation. The background includes a checkerboard or another tessellation, a color gradient, a transparency heat map, a procedurally generated texture, and/or other patterns. A color identified in the partially transparent image may provoke use of a complementary color in the background. The image whose transparency is being visually inspected zooms independently of the background pattern. Animation of the background helps reveal unwanted transparency values, which the user edits as desired.

20 Claims, 4 Drawing Sheets

(58) Field of Classification Search
CPC .. G02B 27/281; G06K 9/627; G06K 9/00778; H04W 24/02; H04L 67/306; G05B 19/048
USPC ..... 345/629
See application file for complete search history.

(56) References Cited

U.S. PATENT DOCUMENTS

| | | | | |
|---|---|---|---|---|
| 6,437,782 | B1 | 8/2002 | Pieragostini et al. | |
| 6,577,762 | B1 * | 6/2003 | Seeger et al. | 382/173 |
| 6,587,128 | B2 | 7/2003 | Kanevsky et al. | |
| 6,970,181 | B1 * | 11/2005 | Fadel | 348/14.01 |
| 7,518,611 | B2 | 4/2009 | Boyd et al. | |
| 8,081,821 | B1 * | 12/2011 | Schaem | 382/173 |
| 8,364,141 | B1 * | 1/2013 | Kateley | H04W 24/08 370/216 |
| 8,405,015 | B1 | 3/2013 | Klein | |
| 2002/0123378 | A1 | 9/2002 | Bucknall et al. | |
| 2003/0043390 | A1 | 3/2003 | Fritz et al. | |
| 2006/0055700 | A1 | 3/2006 | Niles et al. | |
| 2006/0068887 | A1 | 3/2006 | Pryor et al. | |
| 2007/0019247 | A1 | 1/2007 | Yoon | |
| 2008/0165200 | A1 * | 7/2008 | Chow | G06F 3/14 345/531 |
| 2009/0249393 | A1 | 10/2009 | Shelton et al. | |
| 2009/0312062 | A1 * | 12/2009 | Horodezky et al. | 455/566 |
| 2010/0079480 | A1 * | 4/2010 | Murtagh | 345/592 |
| 2013/0215226 | A1 * | 8/2013 | Chauvier et al. | 348/43 |
| 2014/0139546 | A1 * | 5/2014 | Holten | G06T 11/206 345/592 |

OTHER PUBLICATIONS

"Alpha compositing", Retrieved at <<http://en.wikipedia.org/wiki/Alpha_compositing>>, Jun. 13, 2012, pp. 5.

"Color Basics for Print and Web", Retrieved at <<http://desktoppub.about.com/od/howcolorworks/ss/Color-Basics-Desktop-Publishing_8.htm>>, no later than Jun. 15, 2012, pp. 3.

"Getting to Know Clipping Masks and Layer Masks in Photoshop", Retrieved at <<http://www.myinkblog.com/getting-to-know-clipping-masks-and-layer-masks-in-photoshop/>>, no later than Dec. 1, 2009, pp. 19.

"Heat map", Retrieved at <<http://en.wikipedia.org/wiki/Heat_map, May 28, 2012, pp. 2.

"Image Editor", Retrieved at <<http://technet.microsoft.com/en-us/subscriptions/hh315744(v=vs.110).aspx>>, no later than Jun. 15, 2012, pp. 7.

"Procedural texture", Retrieved at <<http://en.wikipedia.org/wiki/Procedural_texture, Jul. 28, 2011, pp. 4.

"Tessellation", Retrieved at <<http://en.wikipedia.org/wiki/Tessellation>, Jun. 13, 2012, pp. 7.

"Transparency (graphic)", Retrieved at <<http://en.wikipedia.org/wiki/Transparency_(graphic)>>, Feb. 13, 2012, pp. 5.

Scott Hanselman, "Visual Studio 11 Beta in Context", Retrieved at <<http://www.hanselman.com/blog/VisualStudio11BetaInContext.aspx>>, Feb. 29, 2012, pp. 24.

Jensen, et al., "Interactive Shader Development", in Proceedings of the ACM SIGGRAPH Symposium on Video Games, Aug. 4, 2007, 7 Pages.

Fitger, Martin, "Visual Shader Programming", in Master's Thesis in Computer Science, KTH Royal Institute of Technology, 2008, Retrieved at <<http://www.nada.kth.se/utbildning/grukth/exjobb/rapportlistor/2008/rapporter08/fitger_martin_08043.pdf>>, Retrieved Date: Sep. 24, 2013, 93 Pages.

Sunset Lake Software, "Introducing the GPUImage Framework", Feb. 12, 2012, 4 Pages.

"International Search Report & Written Opinion for PCT Patent Application No. PCT/US2013/051179", dated Oct. 9, 2013, Filed Date: Jul. 19, 2013, 8 Pages.

* cited by examiner

TIME = T

TIME = T+1

ANIMATED VISUALIZATION OF ALPHA CHANNEL TRANSPARENCY

BACKGROUND

Digital images are often created or obtained in layers. For example, a foreground layer and a background layer, each of which is an image in its own right, may be composed together to form a combined image. When image layers are to be composed (a.k.a., composited) together, portions of one or more layers may be partially or fully transparent, so that layers underneath show through. The information that specifies transparency is often kept in an alpha channel. The alpha channel, sometimes referred to as a matte or a mask, specifies the transparency of pixels, whereas RGB (red green blue) and other channels specify the color of the pixels. Alpha values typically range from 0 (fully transparent) to 1 (fully opaque). Partial transparency is implemented by mixing colors.

Alpha compositing can be used to combine an image with a background to create the appearance of partial or full transparency. After rendering or importing image elements in separate passes, alpha compositing combines the images into a single final image. Compositing is often used to lay computer rendered text or other computer generated images on top of live video footage. An alpha channel matte for the computer generated image specifies the shape of the generated geometry, making it possible to distinguish between parts of the overall image where the generated geometry was drawn and other parts of the image which will contain the live footage.

SUMMARY

Existing mechanisms to evaluate image transparency are inadequate. Rendering a partially transparent image over a checkerboard, or rendering only the matte, for example, will often not give people enough visual information to adequately explore and edit the image's transparency. Some embodiments described herein provide animated visualizations of alpha channel transparency, which bring out deficiencies in the transparency that may otherwise be missed.

Some embodiments assist visual inspection of alpha channel values by displaying on a device screen a partially transparent image rendered over a background pattern. A user specifies a partially transparent image to be visually inspected, such as an image with color channels modulated by an alpha channel.

In some embodiments, the user specifies a background pattern, and in some the background may be chosen automatically and proactively by a given embodiment. The background pattern viewed by the user has a visual appearance, with characteristics such as colors, shape(s), X-Y position, rotational orientation, zoom level (magnification), and distortion. The visual appearance of the background pattern is automatically altered, and the partially transparent image is redisplayed, this time rendered over the altered background pattern. Some embodiments animate the background by repeatedly altering the backgrounds and redisplaying the image rendered over the altered background.

In some embodiments, the background pattern is automatically animated by being scrolled relative to the partially transparent image and/or by being rotated relative to the partially transparent image. In some, a color of the background pattern is changed. In some embodiments, the background pattern pulses as if drawn on an alternately expanding and contracting surface, and in some a shape of the background pattern morphs into another shape.

In some embodiments, the background pattern's visual appearance includes a checkerboard pattern and/or another tessellation pattern. In some, the background includes a color gradient. Some backgrounds include an inverse transparency heat map, namely, a heat map based on the inverse of transparency. Some backgrounds include a procedurally generated texture, a color gradient, or a heat map created by a processor on-the-fly. Some backgrounds include pixel patterns which were already created and stored in memory as existing images, such as checkerboards, other tessellations, gradients, or previously generated textures. Some embodiments identify a color in the partially transparent image and then show in the background pattern at least one color which is a complementary color of the identified color.

In some embodiments, the image whose transparency is being visually inspected is "zoom-independent" of the background pattern. That is, zooming the partially transparent image does not perform a corresponding zoom to the background pattern. For example, the background may not zoom at all, or it may zoom at a different magnification rate than the partially transparent image.

The various features and events noted above can reveal unwanted transparency values to a user who views an image rendered over an animated background. Accordingly, in some embodiments the user submits an edit to the partially transparent image and then views the edited image over the animated background. This can result in user satisfaction with the edit, or in further edits.

In some embodiments, an alpha channel visual inspection code residing in a memory will, upon execution by a processor, display on a screen a sequence of rendered images. Each rendered image contains an initial image (the image being inspected) that is rendered according to an alpha channel, over the top of a background pattern. The background pattern is provided by a background pattern source, such as existing pixels or a procedural texture generated on demand. The background pattern has a visual appearance which is animated (scrolled, rotated, distorted, etc.) by the alpha channel visual inspection code during display of the sequence of rendered images.

The examples given are merely illustrative. This Summary is not intended to identify key features or essential features of the claimed subject matter, nor is it intended to be used to limit the scope of the claimed subject matter. Rather, this Summary is provided to introduce—in a simplified form—some concepts that are further described below in the Detailed Description. The innovation is defined with claims, and to the extent this Summary conflicts with the claims, the claims should prevail.

DESCRIPTION OF THE DRAWINGS

A more particular description will be given with reference to the attached drawings. These drawings only illustrate selected aspects and thus do not fully determine coverage or scope.

DETAILED DESCRIPTION

Overview

Images with an alpha channel transparency are used in many situations, such as icons, in 3D games, and in 3D tools, for example. However, when creating images that include alpha channel transparency, it can be a challenge to ensure that each pixel has the intended level of transparency. It is sometimes hard to know if the alpha channel value is correct (i.e., acceptable) until it is viewed under a variety of conditions.

Figure 4:
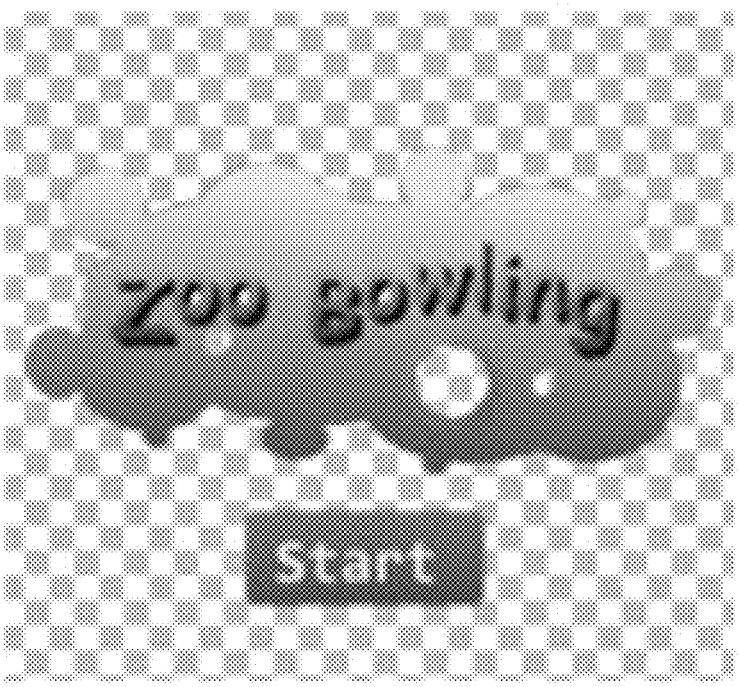
(PRIOR ART) Fig. 4
FIG. 4 shows an example of a conventional presentation of a partially transparent image over a still (non-animated) background.

Some previous approaches to transparency inspection blend alpha values into a specific color, e.g., some versions of Adobe® Photoshop® software uses a shade of pink to represent alpha values (marks of Adobe Systems Inc.). Some approaches draw a checkerboard behind the image being inspected. For example, FIG. 4 illustrates a partially transparent image rendered over a still checkerboard background in a Microsoft® Paint .NET™ environment (marks of Microsoft Corp.). Some approaches allow a user to see only the alpha channel.

Although such familiar approaches can be helpful, someone relying solely on them can also miss defects in the transparency, e.g., when an opaque white pixel that should be transparent happens to be rendered on top of a white square in the checkerboard background. Zooming in to inspect pixels more closely will not detect this problem when the background zooms right along with the image being inspected.

Some embodiments described herein help users detected unwanted transparency values by visualizing the alpha channel transparency over an animating background image. The animating background image may be a checkerboard or another pattern. The background image can be colored; some embodiments use green, white, and/or black by default, but other colors may also be selected. Background images other than a checkerboard can be used in some embodiments, and multiple images can be blended together to provide even greater variety. In some embodiments, animation scrolls the background image up and to the left, however other approaches are possible, e.g., by scrolling in other directions, by rotation of the image, by varying the speed of the animation, or by combinations of these characteristics.

The animation allows for more thorough and more entertaining visual inspection and identification of pixels where the intended alpha transparency is incorrect. Once the incorrect alpha transparency is noticed, the user can make appropriate adjustments to the alpha transparency.

Some embodiments described herein may be viewed in a broader context. For instance, concepts such as transparency, animation, tessellation, complementary colors, and visual inspection may be relevant to a particular embodiment. However, it does not follow from the availability of a broad context that exclusive rights are being sought herein for abstract ideas; they are not. Rather, the present disclosure is focused on providing appropriately specific embodiments. Other media, systems, and methods involving transparency, animation, tessellation, complementary colors, or visual inspection are outside the present scope. Accordingly, vagueness and accompanying proof problems are also avoided under a proper understanding of the present disclosure.

Reference will now be made to exemplary embodiments such as those illustrated in the drawings, and specific language will be used herein to describe the same. But alterations and further modifications of the features illustrated herein, and additional applications of the principles illustrated herein, which would occur to one skilled in the relevant art(s) and having possession of this disclosure, should be considered within the scope of the claims.

The meaning of terms is clarified in this disclosure, so the claims should be read with careful attention to these clarifications. Specific examples are given, but those of skill in the relevant art(s) will understand that other examples may also fall within the meaning of the terms used, and within the scope of one or more claims. Terms do not necessarily have the same meaning here that they have in general usage, in the usage of a particular industry, or in a particular dictionary or set of dictionaries. Reference numerals may be used with various phrasings, to help show the breadth of a term. Omission of a reference numeral from a given piece of text does not necessarily mean that the content of a Figure is not being discussed by the text. The inventors assert and exercise their right to their own lexicography. Terms may be defined, either explicitly or implicitly, here in the Detailed Description and/or elsewhere in the application file.

As used herein, a "computer system" may include, for example, one or more servers, motherboards, processing nodes, personal computers (portable or not), personal digital assistants, smartphones, cell or mobile phones, other mobile devices having at least a processor and a memory, and/or other device(s) providing one or more processors controlled at least in part by instructions. The instructions may be in the form of firmware or other software in memory and/or specialized circuitry. In particular, although it may occur that many embodiments run on workstation or laptop computers, other embodiments may run on other computing devices, and any one or more such devices may be part of a given embodiment.

A "multithreaded" computer system is a computer system which supports multiple execution threads. The term "thread" should be understood to include any code capable of or subject to scheduling (and possibly to synchronization), and may also be known by another name, such as "task," "process," or "coroutine," for example. The threads may run in parallel, in sequence, or in a combination of parallel execution (e.g., multiprocessing) and sequential execution (e.g., time-sliced). Multithreaded environments have been designed in various configurations. Execution threads may run in parallel, or threads may be organized for parallel execution but actually take turns executing in sequence. Multithreading may be implemented, for example, by running different threads on different cores in a multiprocessing environment, by time-slicing different threads on a single processor core, or by some combination of time-sliced and multi-processor threading. Thread context switches may be initiated, for example, by a kernel's thread scheduler, by user-space signals, or by a combination of user-space and kernel operations. Threads may take turns operating on shared data, or each thread may operate on its own data, for example.

A "logical processor" or "processor" is a single independent hardware thread-processing unit, such as a core in a simultaneous multithreading implementation. As another example, a hyperthreaded quad core chip running two threads per core has eight logical processors. A logical processor includes hardware. Processors may be general purpose, or they may be tailored for specific uses such as graphics processing, signal processing, floating-point arithmetic processing, encryption, I/O processing, and so on.

A "multiprocessor" computer system is a computer system which has multiple logical processors. Multiprocessor environments occur in various configurations. In a given configuration, all of the processors may be functionally equal, whereas in another configuration some processors may differ from other processors by virtue of having different hardware capabilities, different software assignments, or both. Depending on the configuration, processors may be tightly coupled to each other on a single bus, or they may be loosely coupled. In some configurations the processors share a central memory, in some they each have their own local memory, and in some configurations both shared and local memories are present.

"Kernels" include operating systems, hypervisors, virtual machines, BIOS code, and similar hardware interface software.

"Code" means processor instructions, data (which includes constants, variables, and data structures), or both instructions and data.

"Program" is used broadly herein, to include applications, kernels, drivers, interrupt handlers, libraries, and other code written by programmers (who are also referred to as developers).

As used herein, "include" allows additional elements (i.e., includes means comprises) unless otherwise stated. "Consists of" means consists essentially of, or consists entirely of. X consists essentially of Y when the non-Y part of X, if any, can be freely altered, removed, and/or added without altering the functionality of claimed embodiments so far as a claim in question is concerned.

"Process" is sometimes used herein as a term of the computing science arts, and in that sense encompasses resource users, namely, coroutines, threads, tasks, interrupt handlers, application processes, kernel processes, procedures, and object methods, for example. "Process" is also used herein as a patent law term of art, e.g., in describing a process claim as opposed to a system claim or an article of manufacture (configured storage medium) claim. Those of skill will understand which meaning is intended in a particular instance, and will also understand that a given claimed process (in the patent law sense) may be implemented using one or more processes (in the computing science sense).

"Automatically" means by use of automation (e.g., general purpose computing hardware configured by software for specific operations discussed herein), as opposed to without automation. In particular, steps performed "automatically" are not performed by hand on paper or in a person's mind; they are performed with a machine.

"Computationally" likewise means a computing device (processor plus memory, at least) is being used, and excludes obtaining a result by mere human thought or mere human action alone. For example, doing arithmetic with a paper and pencil is not doing arithmetic computationally as understood herein. Computational results are faster, broader, deeper, more accurate, more consistent, more comprehensive, and/or otherwise beyond the scope of human performance alone. "Computational steps" are steps performed computationally. Neither "automatically" nor "computationally" necessarily means "immediately".

"Proactively" means without a direct request from a user. Indeed, a user may not even realize that a proactive step by an embodiment was possible until a result of the step has been presented to the user. Except as otherwise stated, any computational and/or automatic step described herein may also be done proactively.

"Scroll" means to translate an image along a straight line. The straight line the image moves along by scrolling may be horizontal, vertical, or at an angle. Scroll is used in contrast to "rotate," which means moving an image about a point or moving an image along a curve rather than along a straight line. Thus, moving a background pattern from side to side, or up, or up and down, or in a zig-zag, are each some of the many possible examples of scrolling the background pattern. Moving the background pattern by spinning it, by spiraling, or by undulating as if it was bobbing on waves, are each some of the many possible examples of rotating the background pattern. Scrolling and rotating are in turn some of the many possible examples of animating the background pattern.

A "color model" means one of the following color models: RGB (red green blue), RYB (red yellow blue), CMYK (cyan magenta yellow black), HSV (hue saturation value), HSL (hue saturation lightness), or any color model that is officially recognized by the International Commission on Illumination (abbreviated CIE for its French name, Commission Internationale de l'Eclairage).

A "complementary color" of color X is a color which is at least one-third of a full color wheel distant from color X in a color model.

An "image" may be a single still image, or it may be a frame from a video or from another sequence of moving images, for example. An image may be partially or entirely computer-generated, and may be partially or entirely captured using a camera, scanner, or other device. An image may be embodied in one or more digital files, using one or more color models. An image per se does not necessarily include an alpha channel, but when image transparency part of the context of an image then it will be understood that alpha values are either stored within the image or otherwise associated with the image.

Throughout this document, use of the optional plural "(s)", "(es)", or "(ies)" means that one or more of the indicated feature is present. For example, "processor(s)" means "one or more processors" or equivalently "at least one processor".

Throughout this document, unless expressly stated otherwise any reference to a step in a process presumes that the step may be performed directly by a party of interest and/or performed indirectly by the party through intervening mechanisms and/or intervening entities, and still lie within the scope of the step. That is, direct performance of the step by the party of interest is not required unless direct performance is an expressly stated requirement. For example, a step involving action by a party of interest such as altering, animating, appearing, changing, displaying, distorting, editing, executing, generating, identifying, morphing, pulsing, receiving, redisplaying, rendering, rotating, scrolling, selecting, showing, specifying, viewing, zooming (and alters, altered, animates, animated, etc.) with regard to a destination or other subject may involve intervening action such as forwarding, copying, uploading, downloading, encoding, decoding, compressing, decompressing, encrypting, decrypting, authenticating, invoking, and so on by some other party, yet still be understood as being performed directly by the party of interest.

Whenever reference is made to data or instructions, it is understood that these items configure a computer-readable memory and/or computer-readable storage medium, thereby transforming it to a particular article, as opposed to simply existing on paper, in a person's mind, or as a transitory signal on a wire, for example. No claim covers a signal per se.

Operating Environments

Figure 1:
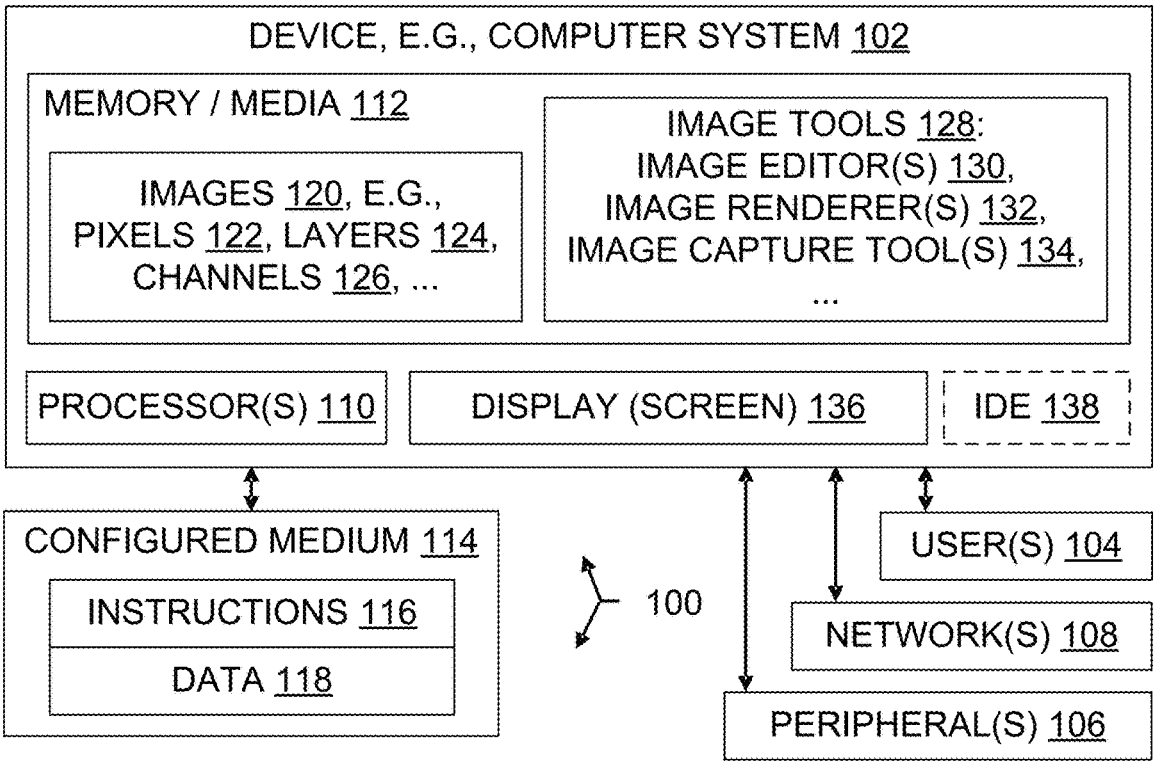
FIG. 1 is a block diagram illustrating a computer system having at least one processor, at least one memory, images, image tools, and other items in an operating environment which may be present on multiple network nodes, and also illustrating configured storage medium embodiments.

With reference to FIG. 1, an operating environment 100 for an embodiment may include a computer system 102. The computer system 102 may be a multiprocessor computer system, or not. An operating environment may include one or more machines in a given computer system, which may be clustered, client-server networked, and/or peer-to-peer networked. An individual machine is a computer system, and a group of cooperating machines is also a computer system. A given computer system 102 may be configured for end-users, e.g., with applications, for administrators, as a server, as a distributed processing node, and/or in other ways.

Human users 104 may interact with the computer system 102 by using displays, keyboards, and other peripherals 106, via typed text, touch, voice, movement, computer vision, gestures, and/or other forms of I/O. A user interface may support interaction between an embodiment and one or more human users. A user interface may include a command line interface, a graphical user interface (GUI), natural user interface (NUI), voice command interface, and/or other interface presentations. A user interface may be generated on a local desktop computer, or on a smart phone, for example, or it may be generated from a web server and sent to a client. The user interface may be generated as part of a service and it may be integrated with other services, such as social networking services. A given operating environment includes devices and infrastructure which support these different user interface generation options and uses.

Natural user interface (NUI) operation may use speech recognition, touch and stylus recognition, gesture recognition both on screen and adjacent to the screen, air gestures, head and eye tracking, voice and speech, vision, touch, gestures, and/or machine intelligence, for example. Some examples of NUI technologies include touch sensitive displays, voice and speech recognition, intention and goal understanding, motion gesture detection using depth cameras (such as stereoscopic camera systems, infrared camera systems, RGB camera systems and combinations of these), motion gesture detection using accelerometers/gyroscopes, facial recognition, 3D displays, head, eye, and gaze tracking, immersive augmented reality and virtual reality systems, all of which provide a more natural interface, as well as technologies for sensing brain activity using electric field sensing electrodes (electroencephalograph and related tools).

One of skill will appreciate that the foregoing aspects and other aspects presented herein under "Operating Environments" may also form part of a given embodiment. This document's headings are not intended to provide a strict classification of features into embodiment and non-embodiment feature classes.

System administrators, developers, engineers, and end-users are each a particular type of user 104. Automated agents, scripts, playback software, and the like acting on behalf of one or more people may also be users 104. Storage devices and/or networking devices may be considered peripheral equipment in some embodiments. Other computer systems not shown in FIG. 1 may interact with the computer system 102 or with another system embodiment using one or more connections to a network 108 via network interface equipment, for example.

The computer system 102 includes at least one logical processor 110. The computer system 102, like other suitable systems, also includes one or more computer-readable storage media 112. Media 112 may be of different physical types. The media 112 may be volatile memory, non-volatile memory, fixed in place media, removable media, magnetic media, and/or optical media. In particular, a configured medium 114 such as a CD, DVD, memory stick, or other removable non-volatile memory medium may become functionally part of the computer system when inserted or otherwise installed, making its content accessible for use by processor 110. The removable configured medium 114 is an example of a computer-readable storage medium 112. Some other examples of computer-readable storage media 112 include built-in RAM, ROM, hard disks, and other memory storage devices which are not readily removable by users 104. Neither a computer-readable medium nor a computer-readable memory includes a signal per se.

The medium 114 is configured with instructions 116 that are executable by a processor 110; "executable" is used in a broad sense herein to include machine code, interpretable code, and code that runs on a virtual machine, for example. The medium 114 is also configured with data 118 which is created, modified, referenced, and/or otherwise used by execution of the instructions 116. The instructions 116 and the data 118 configure the medium 114 in which they reside; when that memory is a functional part of a given computer system, the instructions 116 and data 118 also configure that computer system. In some embodiments, a portion of the data 118 is representative of real-world items such as product characteristics, inventories, physical measurements, settings, images, readings, targets, volumes, and so forth. Such data is also transformed by backup, restore, commits, aborts, reformatting, and/or other operations.

Although an embodiment may be described as being implemented as software instructions executed by one or more processors in a computing device (e.g., general purpose computer, cell phone, or gaming console), such description is not meant to exhaust all possible embodiments. One of skill will understand that the same or similar functionality can also often be implemented, in whole or in part, directly in hardware logic. Alternatively, or in addition to software implementation, the functionally described herein can be performed, at least in part, by one or more hardware logic components. For example, and without excluding other implementations, an embodiment may include hardware logic components such as Field-Programmable Gate Arrays (FPGAs), Application-Specific Integrated Circuits (ASICs), Application-Specific Standard Products (ASSPs), System-on-a-Chip components (SOCs), Complex Programmable Logic Devices (CPLDs), and similar components.

In the illustrated environments 100, one or more images 120 may have pixels 122 organized in layers 124 and/or channels 126, for example. Software image tools 128 such as editors 130, renderers 132, and capture tools 134 (e.g., cameras, scanners) assist with image processing and management by producing and/or transforming images 120. The images 120, tools 128, and other items shown in the Figures and/or discussed in the text, may each reside partially or entirely within one or more hardware media 112, thereby configuring those media. In addition to processors 110 (CPUs, ALUs, FPUs, and/or GPUs), memory/storage media 112, display(s) 136, and battery(ies), an operating environment may also include other hardware, such as buses, power supplies, wired and wireless network interface cards, and accelerators, for instance. CPUs are central processing units, ALUs are arithmetic and logic units, FPUs are floating point processing units, and GPUs are graphical processing units.

A given operating environment 100 may include an Integrated Development Environment (IDE) 138 which provides a developer with a set of coordinated software development tools such as compilers, source code editors, profilers, debuggers, image editors, and so on. In particular, some of the suitable operating environments for some embodiments include or help create a Microsoft® Visual Studio® development environment image editor (marks of Microsoft Corporation) configured to support program development. Some suitable operating environments include Java® environments (mark of Oracle America, Inc.), and some include environments which utilize languages such as C++ or C# ("C-Sharp"), but teachings herein are applicable with images 120 embedded in user interfaces or otherwise utilized in developing software with a wide variety of programming languages, programming models, and programs, as well as with endeavors outside the field of software development per se.

One or more items are shown in outline form in FIG. 1 to emphasize that they are not necessarily part of the illustrated operating environment, but may interoperate with items in the operating environment as discussed herein. It does not follow that items not in outline form are necessarily required, in any Figure or any embodiment.

Systems

Figure 2:
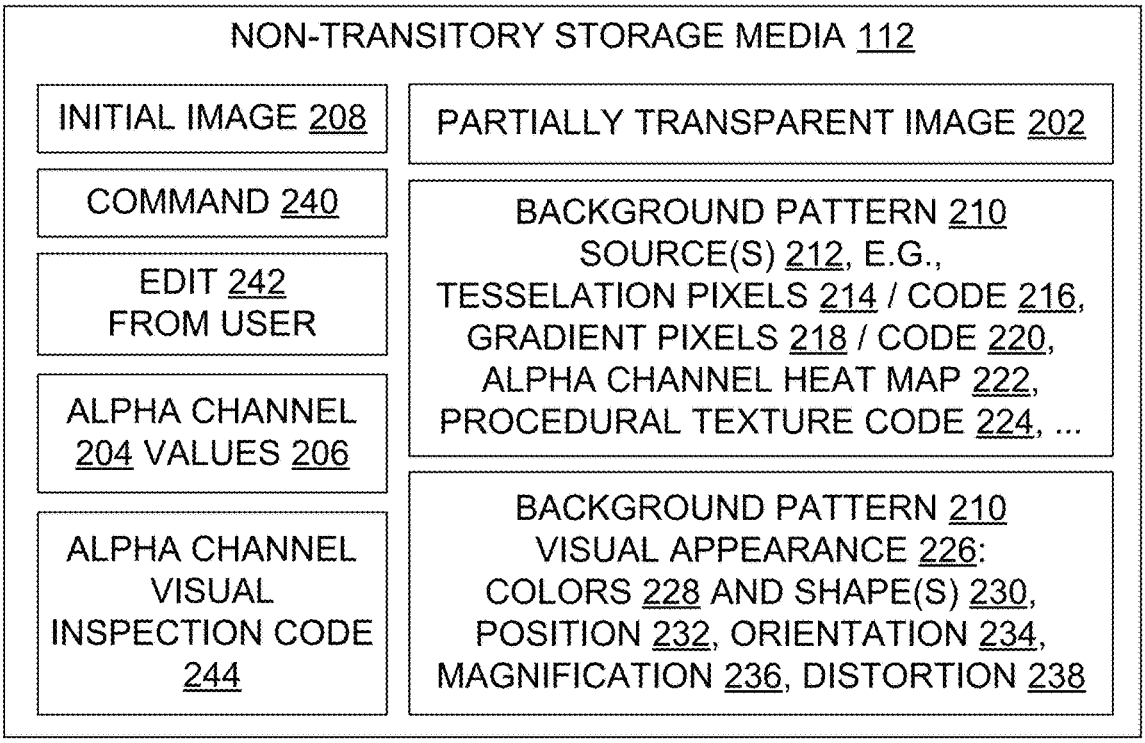
FIG. 2 is a block diagram illustrating aspects of an example architecture designed for visual inspection of image transparency.

FIG. 2 illustrates an architecture which is suitable for use with some embodiments. In general, embodiments may facilitate visual inspection of an image's alpha channel (transparency) values by displaying the image over an animated background pattern.

In some embodiments, a partially transparent image 202, 120 to be inspected may have embedded (precalculated) alpha channel 204 values 206. In some, the partially transparent image 202 may be a combination of an initial image 208, 120 color values with separately stored but associated alpha values 206 which are being inspected.

In some embodiments, a background pattern 210 for animation is provided by a source 212. Some examples of background pattern sources 212 include an existing checkerboard or other tessellation pattern of pixels 214, 122, code 216 for generating such pixels 214, an existing color gradient pattern of pixels 218, 122, code 220 for generating such pixels 218, an alpha channel heat map pattern of pixels 222, 122, and code 224 for generating pixels 122 in a procedural texture. Some of the other examples of background pattern sources 212 include code for generating a heat map 222, and pixels 122 in a generated procedural texture.

In some embodiments, a background pattern 210 has a visual appearance 226, such as the appearance of the pattern 210 on a screen 136 or in a printout. Some characteristics of the background pattern's visual appearance 226 include the colors 228 and shapes 230 of the pattern, as well as the pattern's apparent x-y or x-y-z position 232, apparent rotational orientation 234, magnification 236 (which may be considered a z-axis position or a size relative to the image 202's size), and distortion 238, if any. Magnification 236 reflects the extent to which the user has zoomed in or zoomed out. Distortion 238 reflects the use of simulated lenses (e.g., funhouse mirror effects) or simulated stretchable surfaces (e.g., an expanding/contracting balloon).

In some embodiments, the memory contains user commands 240. Some examples include commands 240 for selecting backgrounds, for selecting animations, and for specifying images 202, as well as routine user interface commands to navigate within a tool 128. In some embodiments, the commands include user edits 242 which specify changes to be made in alpha value(s) 206 of an image 202 as a result of visual inspection of the image's transparency over an animated background pattern 210. In some embodiments, the commands 240 are received and processed using alpha channel visual inspection code 244.

With reference to FIGS. 1 and 2, some embodiments provide a computer system 102 with a logical processor 110 and a memory medium 112 configured by circuitry, firmware, and/or software to support visual inspection of alpha channels (transparency) as described herein.

For example, some embodiments include a computer system 102 having a screen 136, a processor 110, and a memory 112 in operable communication with the processor. An initial image 120, 208 resides in the memory and has color channels 126. An alpha channel 204 also resides in the memory, either as part of the initial image 208 or in association with the initial image. A background pattern source 212 also resides in the memory. An alpha channel visual inspection code 244 residing in the memory will, upon execution by the processor, display on the screen 136 a sequence of rendered images. Each rendered image contains the initial image rendered according to the alpha channel over a background pattern 210. The background pattern 210 is provided by the background pattern source. The background pattern has a visual appearance 226 which is animated by the alpha channel visual inspection code 244 during display of the sequence of rendered images.

In some embodiments, the background pattern source 212 includes one or more of the following: pixels 214 in a tessellation pattern; code 216 which generates a tessellation pattern; pixels 218 in a color gradient; code 220 which generates a color gradient; an inverse transparency heat map 222 or other transparency heat map 222 that is based on the alpha channel; code 244 which generates an inverse transparency heat map based on the alpha channel; 224 code which generates a procedural texture. It will be understood that a checkerboard is one of many possible examples of a tessellation pattern 210; many other familiar tessellation patterns can also be used according to the teachings herein.

In some embodiments, the alpha channel visual inspection code 244 upon execution proactively animates the background pattern. Some of the many possible animations include those in which the background pattern is scrolled relative to the partially transparent image; the background pattern is rotated relative to the partially transparent image; a color of the background pattern is changed; the background pattern pulses as if drawn on an alternately expanding and contracting surface; or a shape of the background pattern morphs into another shape. It will be understood that morphing is an apparently continuous transformation from one shape, e.g., a square, into another shape, e.g., a diamond or an L-shaped rectangular area.

In some embodiments, the alpha channel visual inspection code 244 upon execution proactively identifies a color in the initial image. This can be accomplished by reading pixel color values from memory. The code 244 then displays in the background pattern at least one color which is a complementary color of the identified color. Complementary colors can be determined by a lookup table, or in some color models by performing familiar arithmetic transformations on pixel values.

In some embodiments, the alpha channel visual inspection code upon execution and receipt of a user zoom command 240 zooms the initial image and the alpha channel, without zooming the background pattern. That is, the image 202 whose transparency is being inspected is zoom-independent of the background pattern 210. Zoom-independence may be present, or absent, from a given embodiment regardless of whether the background pattern is animated.

In some embodiments, the system 102 edits the alpha channel, either automatically or in response to a pixel-specific user edit command. Then the system (re)displays the initial image rendered over the animated background pattern according to the edited alpha channel.

In some embodiments peripherals 106 such as human user I/O devices (screen, keyboard, mouse, tablet, microphone, speaker, motion sensor, etc.) will be present in operable communication with one or more processors 110 and memory. However, an embodiment may also be deeply embedded in a system, such that no human user 104 interacts directly with the embodiment. Software processes may be users 104.

In some embodiments, the system includes multiple computers connected by a network. Networking interface equipment can provide access to networks 108, using components such as a packet-switched network interface card, a wireless transceiver, or a telephone network interface, for example, will be present in a computer system. However, an embodiment may also communicate through direct memory access, removable nonvolatile media, or other information storage-retrieval and/or transmission approaches, or an embodiment in a computer system may operate without communicating with other computer systems.

Some embodiments operate in a "cloud" computing environment and/or a "cloud" storage environment in which computing services are not owned but are provided on demand. For example, images 202 may reside on multiple devices/systems 102 in a networked cloud, background patterns 210 may be stored on yet other devices within the cloud, and the code 244 may configure the display 136 on yet other cloud device(s)/system(s) 102.

Processes

Figure 3:
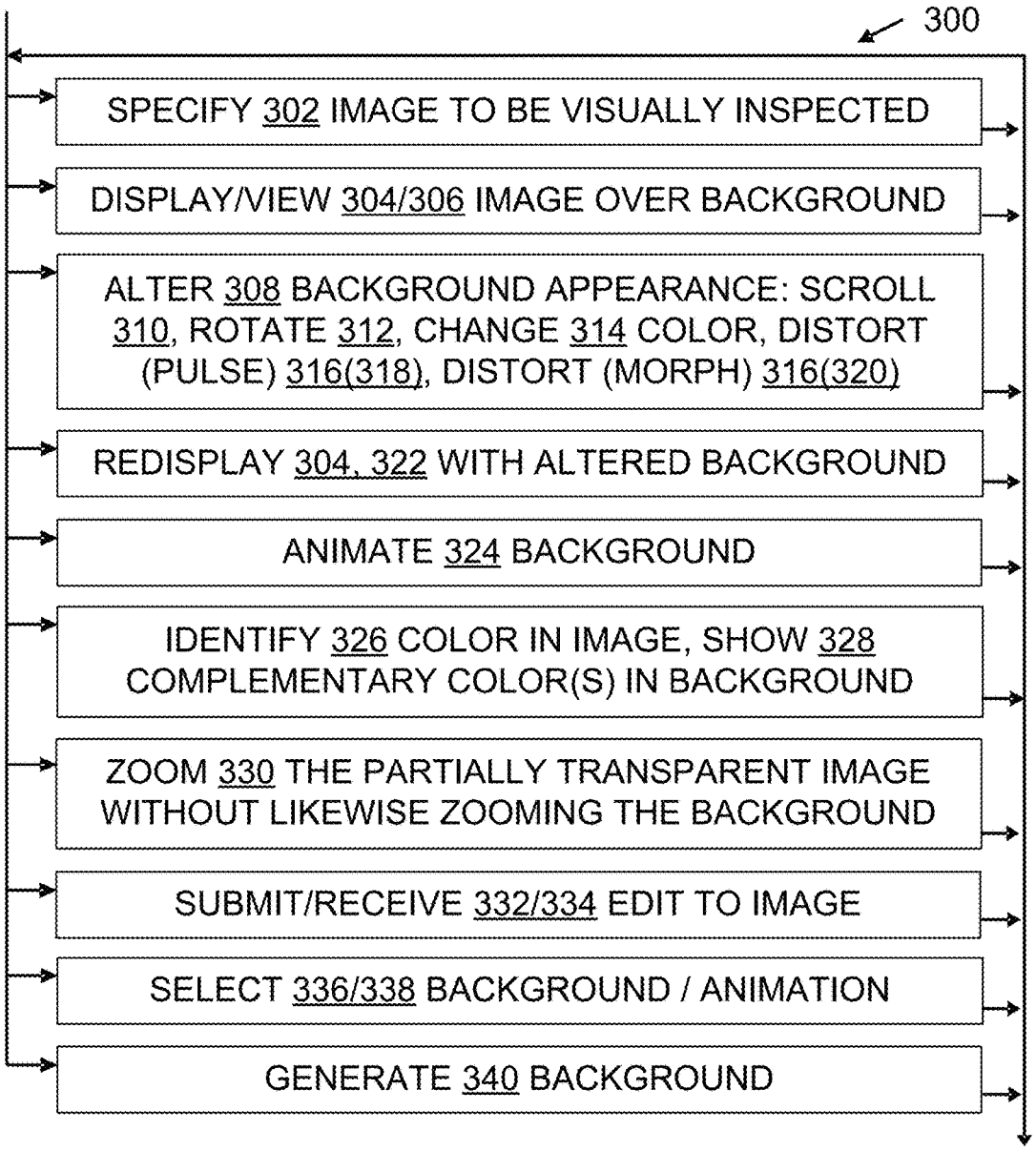
FIG. 3 is a flow chart illustrating steps of some process and configured storage medium embodiments.

FIG. 3 illustrates some process embodiments in a flowchart 300. Processes shown in the Figures may be performed in some embodiments automatically, e.g., by alpha channel visual inspection code 244 under control of a script or otherwise requiring little or no contemporaneous live user input. Processes may also be performed in part automatically and in part manually unless otherwise indicated. In a given embodiment zero or more illustrated steps of a process may be repeated, perhaps with different parameters or data to operate on. Steps in an embodiment may also be done in a different order than the top-to-bottom order that is laid out in FIG. 3. Steps may be performed serially, in a partially overlapping manner, or fully in parallel. The order in which flowchart 300 is traversed to indicate the steps performed during a process may vary from one performance of the process to another performance of the process. The flowchart traversal order may also vary from one process embodiment to another process embodiment. Steps may also be omitted, combined, renamed, regrouped, or otherwise depart from the illustrated flow, provided that the process performed is operable and conforms to at least one claim.

Examples are provided herein to help illustrate aspects of the technology, but the examples given within this document do not describe all possible embodiments. Embodiments are not limited to the specific implementations, arrangements, displays, features, approaches, or scenarios provided herein. A given embodiment may include additional or different features, mechanisms, and/or data structures, for instance, and may otherwise depart from the examples provided herein.

In some embodiments, a user 104 specifies 302 a partially transparent image 202 to be visually inspected, such as an image with color channels modulated by an alpha channel 204. The image may be specified 302 by using familiar file or image identification/selection mechanisms such as a dialog box and file system.

Some embodiments assist visual inspection of alpha channel values 206 of a user-specified 302 image 202 by displaying 304 the partially transparent image 202 rendered over a background pattern 210. The displaying step 304 corresponds generally with a viewing step 306; an embodiment displays 304 what a user views 306 on a screen 136.

In some embodiments, the color channels and the alpha channel are not necessarily merged. The partially transparent image 202 may be formed using a file of RGB color values and a transparency mask from a separate file, for example. Pixels with embedded alpha values (e.g., premultiplied alpha) may also be used. Color models other than RGB (red green blue) may also be used, such as the CMYK (cyan magenta yellow black) model and other color models.

In some embodiments, the user selects 336 a background pattern 210, and in some the background 210 may be selected 336 automatically and proactively by code 244. In either case, the background pattern 210 viewed 306 by the user 104 has a visual appearance 226. The visual appearance 226 has characteristics such as colors 228, shape(s) 230, X-Y position 232 or X-Y-Z position 232 (depending on the embodiment), rotational orientation 234, zoom level (magnification 236), and/or distortion 238 (e.g., that which is modified by funhouse mirror lens effects, flexible surface effects such as pulsing, shape morphing, and so on). The visual appearance 226 of the background pattern 210 is automatically altered 308 by changing one or more of the aforementioned characteristics of the appearance 226. Then the partially transparent image 202 is redisplayed 322, this time being rendered over the altered background pattern 210.

In some embodiments, alteration 308 of the background pattern 210 may involve the embodiment proactively scrolling 310 to change position 232, rotating 312 to change the orientation 234, changing 314 one or more background colors 228, distorting 316, 318 one or more background shapes 230 through pulsing effects, distorting 316, 320 one or more background shapes 230 by morphing into different shape(s), and/or other alterations of visual appearance characteristics.

In some embodiments, the user selects 338 a background pattern animation 324, and in some the background animation may be selected 338 automatically and proactively by code 244. In either case, some embodiments animate 324 the background 210 by repeatedly altering 308 the backgrounds and redisplaying 322 the image 202 rendered over the altered background 210. For example, in some embodiments the background pattern is automatically animated 324 by being continuously or periodically scrolled 310 relative to the partially transparent image and/or by being continuously or periodically rotated 312 relative to the partially transparent image.

In some embodiments, a color of the background pattern is changed 314. For example, changes 314 may include exchanging colors (e.g., green checkerboard squares turn white as white squares turn green) or rotating round robin manner through a sequence of colors (e.g., a first square shows as pink, then green, then white, then black, and an adjacent square shows concurrently as green, then white, then black, then pink). It will be understood that many other color changes are also possible in various embodiments.

In some embodiments, the background pattern pulses 318 as if drawn on an alternately expanding and contracting surface such as a balloon. In some embodiments, a shape of the background pattern morphs 320 into another shape (e.g., checkerboard squares may morph into interlocking L-shapes or into diamonds and then back).

In some embodiments, the background pattern's visual appearance 226 includes a checkerboard pattern 210 and/or another tessellation pattern 210. In some, the background 210 includes a color gradient 218. Some backgrounds 210 include an inverse transparency heat map 222, namely, a heat map based on the inverse of transparency so that low transparency pixels map to a hot color (e.g., red, yellow, orange, pink) and high transparency pixels map to a cool color (e.g., green, blue, purple).

In some embodiments, some backgrounds are generated on demand whereas others are precalculated. Thus, some backgrounds 210 include a procedurally generated texture, a color gradient, or a heat map created by a processor on-the-fly. Some backgrounds include pixel patterns which were already created and stored in memory 112 as existing images 120, such as checkerboards, other tessellations, gradients, or previously generated textures.

Complementary colors may help users identify unwanted alpha values. Accordingly, some embodiments identify 326 a color in the partially transparent image 202 and then show in the background pattern at least one color which is a complementary color of the identified color. For example, if the code 244 determines by scanning image 202 pixels that the image includes a predetermined percentage (e.g., 10%) of pixels which are greenish (i.e., within a predetermined amount of a canonical green specified by the embodiment) then the code 244 selects pink to show 328 the user as one of the background pattern 210 colors.

In some embodiments, the image 202 whose transparency is being visually inspected is "zoom-independent" of the background pattern 210. That is, zooming 330 the partially transparent image does not perform a corresponding zoom to the background pattern 210. For example, the background 210 may not zoom at all, or the background 210 may zoom at a different magnification rate than the partially transparent image 202 magnification rate. This facilitates discovery of unwanted transparency by zooming the image 202, because the background behind a given pixel changes when the background is not zoomed the same as the image.

More generally, many embodiments reveal unwanted transparency values 206 to a user who views an image 202 rendered over an animated 324 background 210. Accordingly, in some embodiments the user submits 332 an edit 242 to the partially transparent image and then views 306 the edited image over the animated background. This can result in user satisfaction with the edit, or in further edits. The edit submitting step 332 corresponds generally with an edit receiving step 334; a user submits 332 an edit which the embodiment receives 334 through familiar user interface mechanisms, e.g., a command line or a familiar pixel editing mechanism of the kind used in paint programs and other image editors.

In some embodiments, an alpha channel visual inspection code 244 residing in a memory 112 will, upon execution by a processor 110, display 304 on a screen 136 a sequence of rendered images 202. Each rendered image 202 contains an initial image (the image being inspected) that is rendered according to an alpha channel over the top of a background pattern 210. The background pattern is provided by a background pattern source, such as pre-existing pixels or a procedural texture that is instead generated 340 on demand. The background pattern has a visual appearance which is animated 324 (scrolled, rotated, distorted, etc.) by the alpha channel visual inspection code 244 during display of the sequence of rendered images, thereby assisting detection of unwanted transparency values.

Configured Media

Some embodiments include a configured computer-readable storage medium 112. Medium 112 may include disks (magnetic, optical, or otherwise), RAM, EEPROMS or other ROMs, and/or other configurable memory, including in particular computer-readable media as opposed to propagated signal media. The storage medium which is configured may be in particular a removable storage medium 114 such as a CD, DVD, or flash memory. A general-purpose memory, which may be removable or not, and may be volatile or not, can be configured into an embodiment using items such as alpha channel visual inspection code 244, alpha channel heat maps 222, and animated background patterns 210, in the form of data 118 and instructions 116, read from a removable medium 114 and/or another source such as a network connection, to form a configured medium. The configured medium 112 is capable of causing a computer system to perform process steps for inspecting image transparency as disclosed herein. FIGS. 1 through 3 thus help illustrate configured storage media embodiments and process embodiments, as well as system and process embodiments. In particular, any of the process steps illustrated in FIG. 3, or otherwise taught herein, may be used to help configure a storage medium to form a configured medium embodiment.

Additional Example

Additional details and design considerations are provided below. As with the other examples herein, the features described may be used individually and/or in combination, or not at all, in a given embodiment.

Those of skill will understand that implementation details may pertain to specific code, such as specific APIs and specific sample programs, and thus need not appear in every embodiment. Those of skill will also understand that program identifiers and some other terminology used in discussing details are implementation-specific and thus need not pertain to every embodiment. Nonetheless, although they are not necessarily required to be present here, these details are provided because they may help some readers by providing context and/or may illustrate a few of the many possible implementations of the technology discussed herein.

Figure 5:
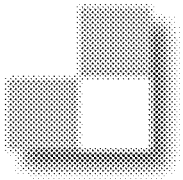
(PRIOR ART) Fig. 5
FIG. 5 shows a checkerboard source image, which is used in conventional presentations and which can be adapted by animation for use in some embodiments presented herein.
Figure 6:
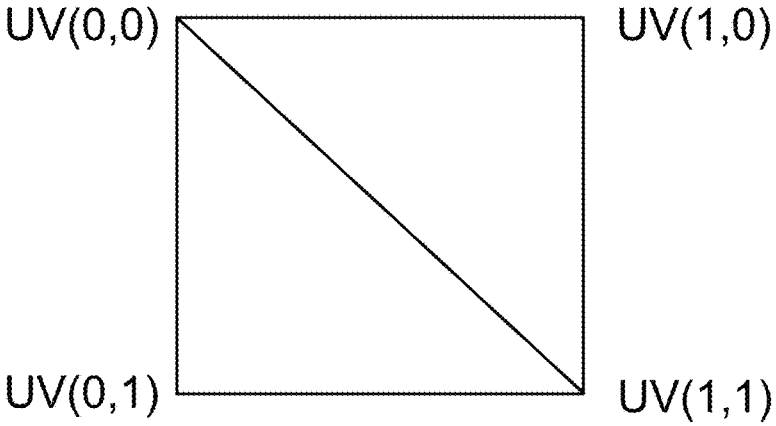
FIG. 6 is a diagram showing quad, triangle, and vertex information which is sent to a GPU (graphical processing unit) for drawing a background checkerboard in some embodiments.

FIG. 4 illustrates use of a checkerboard behind an image in a Microsoft® Paint .NET™ environment (marks of Microsoft Corporation). Aspects of this example can be adapted for use according to the teachings herein. For example, one implementation renders using Microsoft® Direct3D™ technology for hardware accelerated graphics (marks of Microsoft Corporation). In 3D space, the implementation draws a background quad the size of the image being edited. A checkerboard image (FIG. 5) is drawn as part of the background quad. The quad is made up of two triangles. Each triangle has three vertexes, and each vertex contains texture coordinates (UV) that map to the checkerboard image (FIG. 6). A matrix is applied to the texture coordinates to scale and repeat the checkerboard image on the quad.

Figure 7:
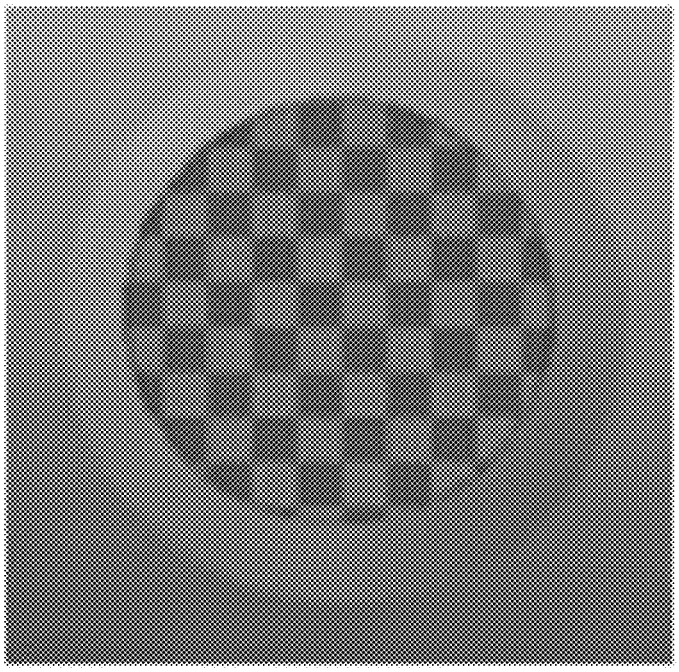
FIGS. 7 and 8 illustrate an animated checkerboard background at different points in time, according to some embodiments presented herein.
Figure 8:
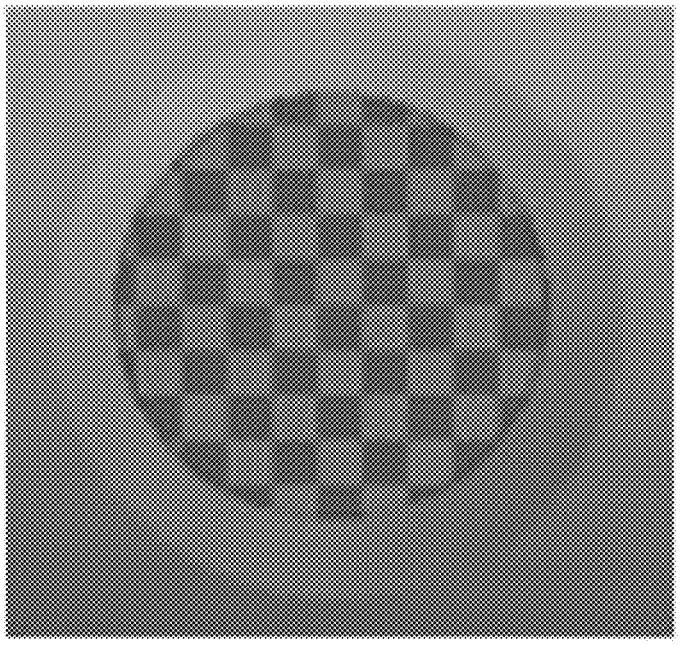

In this implementation, a pixel shader is used to draw the background quad. The pixel shader takes time as an input to the shader, and uses time to animate 324 the texture coordinates (position 232). The value of time is added to the value of the texture coordinates. The pixel shader also takes color as an input to the shader, allowing the checkerboard pattern 210 to be colored green, white, black or any other color one may want. Optionally, time could also be used to modulate the color 228 of the checkerboard. Once this background quad is drawn, the implementation draws the image 202 being edited over the same pixels. As the image 202 is drawn in each successive position, the implementation uses familiar alpha blending to blend image pixels with the background pixels (FIGS. 7 and 8).

CONCLUSION

Although particular embodiments are expressly illustrated and described herein as processes, as configured media, or as systems, it will be appreciated that discussion of one type of embodiment also generally extends to other embodiment types. For instance, the descriptions of processes in connection with FIG. 3 also help describe configured media, and help describe the operation of systems and manufactures like those discussed in connection with other Figures. It does not follow that limitations from one embodiment are necessarily read into another. In particular, processes are not necessarily limited to the data structures and arrangements presented while discussing systems or manufactures such as configured memories.

Not every item shown in the Figures need be present in every embodiment. Conversely, an embodiment may contain item(s) not shown expressly in the Figures. Although some possibilities are illustrated here in text and drawings by specific examples, embodiments may depart from these examples. For instance, specific features of an example may be omitted, renamed, grouped differently, repeated, instantiated in hardware and/or software differently, or be a mix of features appearing in two or more of the examples. Functionality shown at one location may also be provided at a different location in some embodiments.

Reference has been made to the figures throughout by reference numerals. Any apparent inconsistencies in the phrasing associated with a given reference numeral, in the figures or in the text, should be understood as simply broadening the scope of what is referenced by that numeral. Different instances of a given reference numeral may refer to different embodiments, even though the same reference numeral is used.

As used herein, terms such as "a" and "the" are inclusive of one or more of the indicated item or step. In particular, in the claims a reference to an item generally means at least one such item is present and a reference to a step means at least one instance of the step is performed.

Headings are for convenience only; information on a given topic may be found outside the section whose heading indicates that topic.

All claims and the abstract, as filed, are part of the specification.

While exemplary embodiments have been shown in the drawings and described above, it will be apparent to those of ordinary skill in the art that numerous modifications can be made without departing from the principles and concepts set forth in the claims, and that such modifications need not encompass an entire abstract concept. Although the subject matter is described in language specific to structural features and/or procedural acts, it is to be understood that the subject matter defined in the appended claims is not necessarily limited to the specific features or acts described above the claims. It is not necessary for every means or aspect identified in a given definition or example to be present or to be utilized in every embodiment. Rather, the specific features and acts described are disclosed as examples for consideration when implementing the claims.

All changes which fall short of enveloping an entire abstract idea but come within the meaning and range of equivalency of the claims are to be embraced within their scope to the full extent permitted by law.

What is claimed is:

1. A computer-readable storage medium configured with data and with instructions that when executed by at least one processor causes the processor(s) to perform a method to assist visual inspection of alpha channel values, the method comprising the steps of:

displaying on a device screen a partially transparent image rendered over and alpha blended with a background pattern, the background pattern having a visual appearance which is designed for detecting alpha channel defects as opposed to being a real-world image;

automatically altering the visual appearance of the background pattern;

redisplaying on the screen the partially transparent image rendered over and alpha blended with the altered background pattern; and animating the background by repeating the altering and redisplaying steps, thereby providing an appearance of background movement.

2. The configured storage medium of claim 1, wherein the background pattern is automatically animated in at least one of the following ways:

the background pattern is scrolled relative to the partially transparent image;

the background pattern is rotated relative to the partially transparent image;

the background pattern pulses as if drawn on an alternately expanding and contracting surface;

a shape of the background pattern morphs into another shape.

3. The configured storage medium of claim 2, wherein the background pattern's visual appearance includes at least one of the following:

a checkerboard pattern;

a tessellation pattern;

a color gradient;

an inverse transparency heat map;

a procedural texture.

4. The configured storage medium of claim 1, wherein the background pattern's visual appearance includes at least one of the following:

a checkerboard pattern;

a tessellation pattern;

a color gradient;

an inverse transparency heat map;

a procedural texture.

5. The configured storage medium of claim 1, wherein the method further comprises:

identifying a color in the partially transparent image; and showing in the background pattern at least one color which is a complementary color of the identified color.

6. The configured storage medium of claim 1, wherein the method further comprises zooming the partially transparent image without performing a corresponding zoom to the background pattern.

7. The configured storage medium of claim 1, wherein the method further comprises receiving from a user an edit to the partially transparent image and then repeating the animating step with the edited partially transparent image.

8. A process for visually inspecting alpha channel values, the process comprising the steps of:

specifying to a computer system a partially transparent image to be visually inspected;

viewing on a screen of the computer system the partially transparent image rendered over an animated background pattern, at least a portion of the background pattern being visible through at least part of the partially transparent image, the animated background pattern appearing to move while it is being viewed on the screen of the computer system, the background pattern having a visual appearance which is designed for alpha channel inspection as opposed to being a real-world image; and zooming and viewing the partially transparent image without viewing any corresponding zoom to the animated background pattern.

9. The process of claim 8, further comprising submitting an edit to an alpha channel value of the partially transparent image and then viewing on the screen the edited partially transparent image rendered over the animated background pattern.

10. The process of claim 8, further comprising selecting at least one of the following animations for the animated background pattern:

scrolling the background pattern relative to the partially transparent image;

rotating the background pattern relative to the partially transparent image.

11. The process of claim 8, further comprising selecting at least one of the following animations for the animated background pattern:

changing a color of the background pattern;

distorting the background pattern.

12. The process of claim 8, further comprising selecting at least one of the following initial patterns for the animated background pattern:

a checkerboard pattern;

a tessellation pattern;

a color gradient;

a procedural texture.

13. The process of claim 8, further comprising selecting an inverse transparency heat map as an initial pattern for the animated background pattern.

14. The process of claim 8, further comprising morphing a shape of the background pattern into another shape.

15. A computer system comprising:

a screen;

a processor;

a memory in operable communication with the processor;

an initial image residing in the memory and having color channels;

an alpha channel residing in the memory;

a background pattern source residing in the memory; and an alpha channel visual inspection code residing in the memory which upon execution by the processor displays on the screen a sequence of rendered images, each rendered image containing the initial image rendered according to the alpha channel over a background pattern, the background pattern being provided by the background pattern source, the background pattern having a visual appearance which is animated by the alpha channel visual inspection code during display of the sequence of rendered images, the background pattern thus appearing to move while it is displayed on the screen of the computer system, the background pattern designed for inspecting the alpha channel for defects as opposed to being a real-world image;

wherein the background pattern source comprises at least one of the following:

pixels in a color gradient code which generates a color gradient an inverse transparency heat map based on the alpha channel;

code which generates an inverse transparency heat map based on the alpha channel;

code which generates a procedural texture;

a source of a background pattern which pulses as if drawn on an alternately expanding and contracting surface;

a source of a background pattern having a shape which morphs into another shape.

16. The system of claim 15, further comprising a background pattern source which comprises at least one of the following:

pixels in a tessellation pattern;

code which generates a tessellation pattern.

17. The system of claim 15, wherein the alpha channel visual inspection code upon execution proactively animates the background pattern in at least one of the following ways:

the background pattern is scrolled relative to the partially transparent image;

the background pattern is rotated relative to the partially transparent image.

18. The system of claim 15, wherein the alpha channel visual inspection code upon execution proactively identifies a color in the initial image and then displays in the background pattern at least one color which is a complementary color of the identified color.

19. The system of claim 15, wherein the alpha channel visual inspection code upon execution and receipt of a user zoom command zooms the initial image and the alpha channel, without zooming the background pattern.

20. The system of claim 15, wherein the system edits the alpha channel and then displays the initial image rendered over the animated background pattern according to the edited alpha channel.

* * * * *